United States Patent [19]

Eickmann

[11] 4,034,651

[45] July 12, 1977

[54] FLUID-OPERATED RADIAL PISTON DEVICES

[76] Inventor: Karl Eickmann, 2420 Isshiki Hayama, Kanagawa, Japan

[21] Appl. No.: 577,338

[22] Filed: May 14, 1975

Related U.S. Application Data

[63] Continuation-in-part of Ser. No. 424,580, Dec. 13, 1973, abandoned.

[51] Int. Cl.[2] ..... P01B 13/06

[52] U.S. Cl. ..... 91/488

[58] Field of Search ..... 91/487, 488, 491, 495, 91/496

[56] References Cited

U.S. PATENT DOCUMENTS

| | | | |
|---|---|---|---|
| 2,284,763 | 6/1942 | Olson | 91/495 |
| 2,972,961 | 2/1961 | Clark | 91/488 |
| 2,977,891 | 4/1961 | Bishop | 91/485 |
| 3,058,429 | 10/1962 | Rocheville | 91/495 |
| 3,223,046 | 12/1965 | Eickmann | 91/488 |
| 3,277,834 | 10/1966 | Eickmann | 91/496 |

FOREIGN PATENT DOCUMENTS

| | | | |
|---|---|---|---|
| 757,239 | 4/1954 | Germany | 91/491 |

*Primary Examiner*—William L. Freeh

[57] ABSTRACT

A fluid-operated radial piston machine has two rotors rotating at the same angular velocity, with a working rotor being formed with substantially radial working chambers having working fluid flowing therethrough and having pistons reciprocable in the working chambers. The other rotor is a bearing rotor. Connections members are interposed between the pistons and the bearings rotor and are pivotally seated in the bearing rotor as well as in the respective pistons. The bearing rotor has axially extending incompletely circular grooves receiving cylindrical heads on the connection members, and the inner ends of the connection members are formed with cylindrical or spherical bearing surfaces seating in the pistons. Fluid pressure chambers are formed on the various bearing surfaces to receive fluid under pressure to reduce friction.

12 Claims, 5 Drawing Figures

Fig. 2
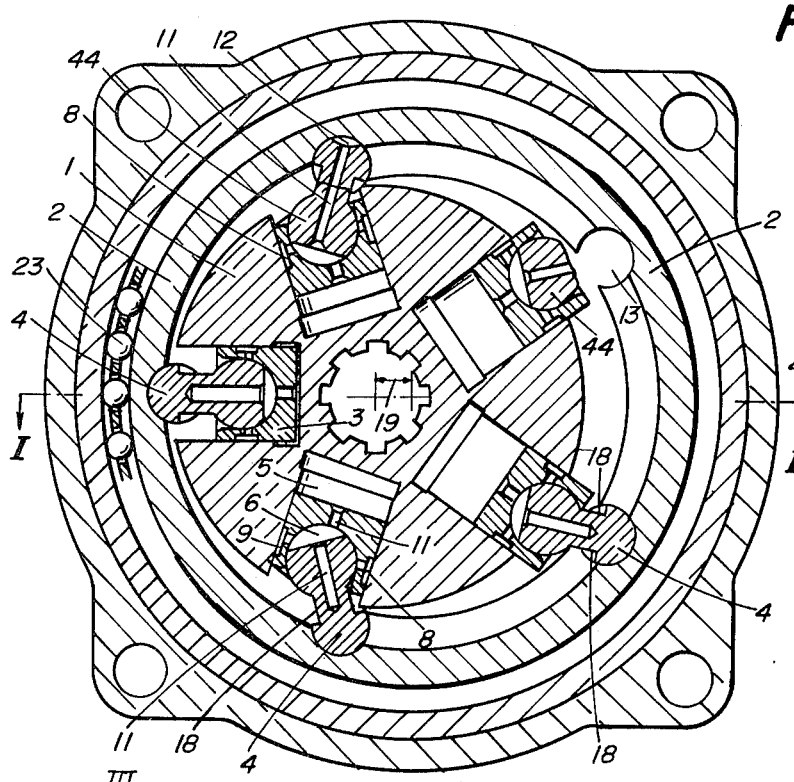
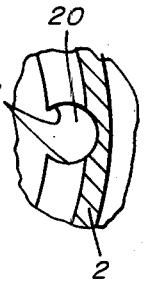
Fig. 2A
Fig. 1
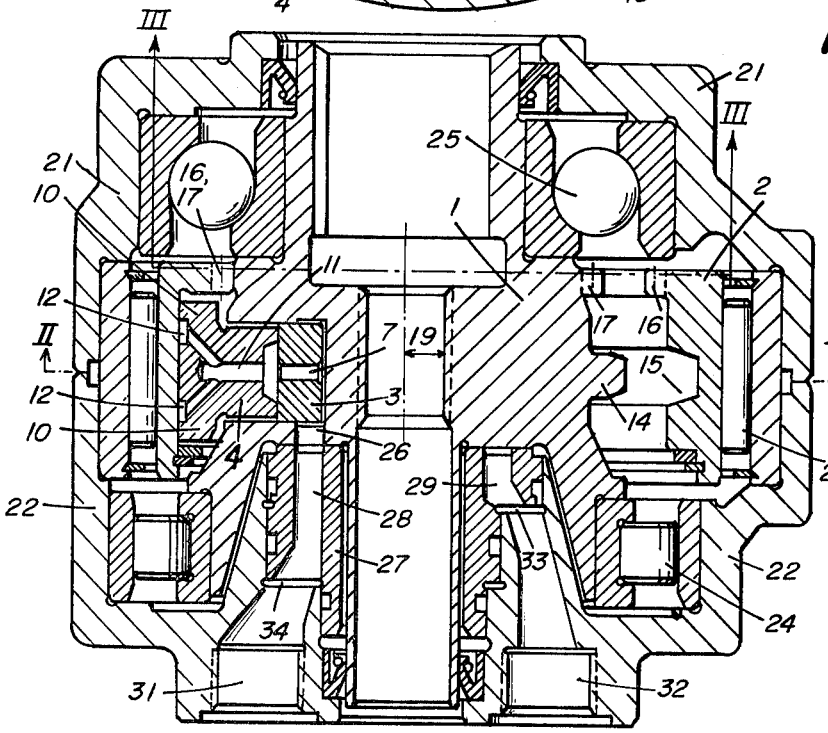
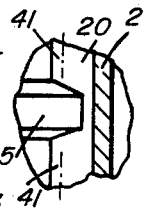
Fig. 1A

FLUID-OPERATED RADIAL PISTON DEVICES

This application is a combination-in-part application of application Ser. No. 424,580, filed Dec. 13, 1973 and now abandoned.

FIELD AND BACKGROUND OF THE INVENTION

This invention relates to fluid-operated radial piston machines or radial chamber machines having two rotors rotating at equal angular velocities with one rotor being formed with working chambers through which the working fluid flows. More particularly, the present invention is directed to such machines including piston connection members extending between the two roters, which rotate in synchronism, and serving to transmit power between the pistons, which increase and diminish the so-called delivery or capacity chambers, provided in a working rotor, and the other rotor or bearing rotor.

Hitherto known types of fluid-operated radial piston or radial chamber machines, such as vane pumps and motors, radial piston pumps, motors, and compressors, as well as internal combustion motors and mechanisms, are quite reliable in service and work with a satisfactory efficiency.

A fluid-operated radial piston machine comprising two rotors turning at equal angular velocities is disclosed in U.S. Pat. No. 3,273,511. However, the construction disclosed in this patent is not suitable as a fluid motor. Another fluid-operated radial piston machine is known, for example, from U.S. Pat. No. 3,223,046, where piston shoes are used between the working pistons and a rotor for transmitting power. According to the design of U.S. Pat. No. 3,223,046, however, the relative movements between the piston shoes and the rotor along which they glide are still relatively important. It is true that these relative movements are already of a very small extent because, while the absolute value of the angular velocity of the rotor $V_u = 2\ R\pi\ n$, where $R$ is the radius and $n$ is the angular velocity, the relative speed between the piston shoes and the rotor on which they glide is only $V_r = 4\ e\ n$, where $e$ is the eccentricity between the axes of the two rotors. As the value of $e$ is much smaller than that of $R$, the relative speed between the respective component parts is also much smaller than the absolute angular velocity of the rotor on which the piston shoes glide, practically about 1/5 to 1/10 of the latter.

This is why radial piston machines, such as shown in U.S. Pat. No. 3,223,046, are highly efficient and effective, and have already proved very reliable in practice, not only in America and Europe, but also in Asia.

Nevertheless, the efficiency and performance of these machines is still limited, and can be increased beyond the values already attained. This can be done, particularly by designing the fluid-operated radial piston machines for high pressure and by further reducing the relative speed between the power-transmitting connection members or shoes and the associated rotors so that the relative speed obtained in prior art constructions appear still high relative to those possible with the arrangement of the present invention.

SUMMARY OF THE INVENTION

The invention is directed to overcoming the limitations of known radial piston machines and to providing a new fluid-operated radial piston machine permitting high efficiencies and performances and, in addition, particularly suitable for this purpose.

In accordance with the invention, this result is obtained, in machines of the type previously mentioned, in a simple and satisfactory manner by providing connection members between the displacers or pistons and engaging into one of the rotors, namely the working rotor, and the other rotor, namely the bearing rotor, with the connection members being pivotally seated in the bearing rotor for swinging about axes extending parallel to the rotor axes. Preferably, the inner ends of the connection members are also pivotally seated in the pistons.

The relative speed between each connection member and the rotor in which it is seated is thereby further reduced to a value much smaller with respect to the relative speed between the piston shoes and rotor of U.S. Pat. No. 3,223,046. This further reduction of the relative velocity between the power transmitting means and the rotor results in a further reduction of the friction, the possibility of a higher pressure loading, and thus a considerable furhter increase in the efficiency and performance of the machine. The relative velocity between the connection member and the rotor is reduced, in a machine embodying the invention, to $V_p = 2\lambda r$ where lambda ($\lambda$) is the swing angle of the connection member and $r$ is the radius of the portion of the connection member pivotally seated in the rotor. This velocity is only a small fraction of the relative velocity of the piston shoes, as set forth in equation (2) and, consequently, the machine embodying the invention provides a shorter friction path and thus a smaller friction.

To improve the results obtained in accordance with the invention, pressure fluid pockets may be provided in the partly cylindrical portion of each connection member seated in the rotor, these pockets being supplied by pressure fluid from the associated working chamber through bores in the piston and in the connection member. The friction between the rotor and the connection member seated therein thereby is further reduced and, at the same time, the capacity of the machine to work under higher pressure is assured so that its performance possibilities are further increased. Advantageously not only one pressure fluid pocket is provided between each connection member and the rotor, but preferably more than one pocket, and in general two pockets, are provided so that at least one fluid pressure pocket is offset relative to the plane of the piston axis and at least one further pocket is formed behind this plane. Corresponding connection bores preferably are provided in the connection member.

In order further to increase the performance and efficiency of the machine embodying the invention, the bearing rotor is formed with a circular groove into which an outer rib of the working rotor may project. A large eccentricity thus can be provided between the axes of the two rotors and, consequently, a particularly long stroke of the pistons can be obtained. Thereby, the capacity delivery of the machine per revolution is increased which, again, results in a considerably higher power output because, as is well known, the power of a fluid-operated machine is proportional to the pressure and to the volumetric displacement.

The mentioned pressure fluid pockets, between each connection member and the rotor, are located at opposite sides of the circular groove provided in the rotor.

At both sides of the circular groove of the bearing rotor, the seats, receiving portions of the respective connection members, may engage these portions along a circumference of more than 180° so that the connection members cannot fall out of the rotor. The angle of the swing range of the connection member is not effected thereby because, within the zone of the circular groove of the rotor, the engagement is less than 180°. In accordance with a preferred embodiment of the invention, elements limiting the pivotal movement of the connection members may be provided. A disengagement of the connection members from the pistons is there by prevented even in cases where they are not secured against relative disengagement. This measure simplifies the shape of the pistons and thereby makes the manufacture become less expensive.

The large eccentricity between the rotors results in particularly large angles of attack and swing angles of the connection members providing the rotation. Such large angles of attack and swing ranges are desirable, particularly in high pressure fluid motors, because they result in a pressure force directed against the rotors almost tangentially. this tangential, or nearly tangential, attack of the piston force on the rotor produces a torque in the rotor almost directly without a transformation through secondary means. Thus, in accordance with the invention, the torque is produced in a particularly rational manner with particularly low losses, and it is therefore very strong.

To produce this tangential attack of the piston forces on the rotor, even at high fluid pressures, it is necessary to provide tangential pressure fluid pockets in the circumferential periphery of the pistons, which pistons are larger than those provided in U.S. Pat. No. 3,225,706 which discloses such tangential balancing of the pistons. Due to the wide maximum swing angle of the connection members of the invention, the size of the known tangential balancing pressure pockets in the piston circumferential periphery is no longer sufficient.

Provided the tangential pressure fluid pockets in the respective pistons, and the pressure fluid pockets between the connection members and the rotor, are exactly pisitioned, the radial action of the pressure fluid on a piston head can be transmitted to the rotor, to a very high extent, directly in the tangetial or circumferential direction of the rotor. Thus, the connection members are only in a small proportion force transmitting means and, for the most part, become means determining the attack direction of a pressure fluid. Thereby, a nearly direct action of the pressure fluid in the circumferential direction of the rotor is obtained. The torque is reduced, in this case, by only a small extent by mechanical parts, mostly by the positive displacement force of the pressure fluid. This is the most friction-free and most efficient production of a torque in a machine, particularly of a high torque exceeding the electrical forces.

In most of the actual constructions embodying the invention, a coupling mechanism is provided between the two rotors to assure the equal angular velocity of these rotating parts. For this purpose, in the most simple embodiments a part of the bearing rotor is provided with an internal toothing and part of the working rotor is provided with an external toothing, or vice versa. For the eccentricities used in practice, the toothed parts are dimensioned so as to mesh with each other, whereby synchronism between the two rollers is assured and the torque are transmitted from one part to the other.

The machine embodying the invention may be designed with constant strokes or with adjustable strokes, either pressure or displacement strokes. In the adjustable design, one of the two rollers is so mounted that the mutual eccentricity is adjustable by means which are known per se and which therefore have not been shown. In accordance with the adjusted eccentricity, the coupling toothings engage each other to a greater or less degree.

An object of the invention is to provide an improved fluid-operated radial piston or radial chamber machine.

Another object of the invention is to provide such a machine including piston connection members extending between and engaged in both rotors.

A further object of the invention is to provide such a machine having a greatly increased efficiency.

For an understanding of the principles of the invention, reference is made to the following description of a typical embodiment thereof as illustrated in the accompanying drawings.

BRIEF DESCRIPTION OF THE DRAWINGS

FIG. 1 is a longitudinal or axial sectional view taken along the line I—I of FIG. 2;

FIG. 1A is a somewhat enlarged partial sectional view corresponding to FIG. 1;

FIG. 2 is a radial or diametric sectional view taken along the line II—II of FIG. 1; and FIG. 2A is a somewhat enlarged partial sectional view corresponding to FIG. 2.

DESCRIPTION OF THE PREFERRED EMBODIMENT

Figure 3:
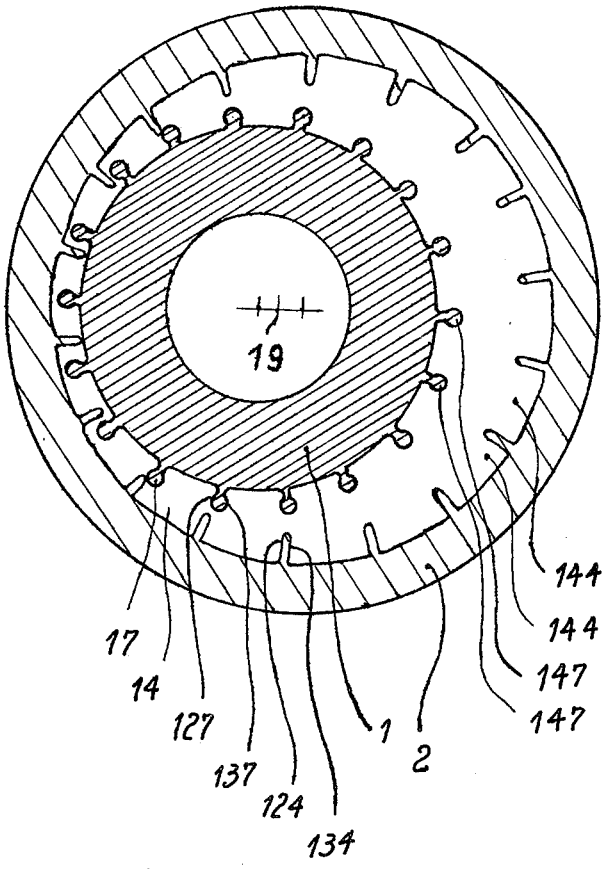
FIG. 3 is a partial cross-sectional view showing FIG. 7 along the line III—III of FIG. 1.

Referring to the drawing, a fluid-operated rotor 1 is rotatably mounted in a casing 21 and a cover 22 by means of bearings 24 and 25. A bearing rotor 2 is also mounted in casing 21 and cover 22 through the medium of a bearing 23, and its axis is offset, relative to that of rotor 1, by an eccentricity 19. Bearing 23 may be mounted or retained in casing 21 or cover 22, or both, in a fixed position, as shown in the drawings, or in an adjusting mechanism, which has not been shown because it is known, in principle, from the previously mentioned patents, so that the eccentricity 19 can be adjusted.

In a known manner, rotor 1 is formed with radial working chambers, for example, cylinders 5, in which displacers, for example, pistons 3, are received for radial or approximately radial reciprocation. Thereby, during periodic rotation of rotor 1, the volume of chambers 5 is increased, to receive fluid, and decreased, to deliver fluid. Fluid may be supplied to and delivered from working chambers or cylinders 5 through passages 6 extending through rotor 1 in a known manner in either the axial or radial direction. There is no set rule for the design in this respect.

In FIG. 1, an example of an axial supply and delivery arrangement is shown, which is particularly suitable for high pressures. The arrangement comprises pressure fluid supplied in delivery connections 31 and 32, respectively, which are connected through respective fluid chamber 33 and 34 and passages 28 and 29 in a pressure body 27 with rotor passages 26, so that fluid can enter and be discharged from chambers 5. Respective sets of passages are provided for each working chamber or cylinder 5.

In accordance with the invention, connection members 4 are engaged between pistons 3, in rotor 1, and bearing rotor 2, and are pivotally seated both in the respective piston and in the rotor 2. To this end, pistons 3 are formed with known spherical or cylindrical seats for the respective connection member.

Rotor 2 is formed, in accordance with the invention, with a swing seat 20 for each connection member 4. In FIGS. 2 and 2A, at one of the cylinders, seat 20 is shown without the connection member in order to illustrate its preferred shape more clearly. In general, each seat 20 comprises an axially extending bore which is interrupted by a circular groove 15 in rotor 2 and which, in turn, is partly interrupted by the bore. At both sides of the circular groove 15, each seat for a connection member is shaped to extend through an angle greater than 180°, to form extensions 41 for retaining the radially outer portion of the associated connection member 4. Thus, the outer portions of the connection members 4 are enclosed through an angle of more than 180°, so that the members 4 cannot disengage from the associated seats 20.

The outer portions of connection members 4 are introduced into their respective seats 20 in the axial direction of rotor 2, from one end, until the middle of each outer portion is positioned in alignment with circular groove 15. Thus, the middle portion of the respective connection member 4 can swing within the associated circular groove 15 of rotor 2 through a wide range, that is, through a large swing angle. The radially outer portions of connection members 4 are of a preferably cylindrical shape having an axis which is parallel to the axis of roller 2 and a diameter facilitating an easy retention in seat 20 and a swinging movement. Because the axially extending cylindrical surfaces of the outer portions of connection members 4 are partly enclosed by extensions 41 of the associated seats 20, connection members 4, once introduced into the respective seats, cannot fall out therefrom and, in addition, can swing therein without obstruction.

The center portion of each connection member 4, connecting the outer portion seated in seat 20 with the radially inner portion seated in the associated piston 3, is preferably narrowed in order to permit a wide swing angle of the member 4. Recesses 18 may be provided on the central portion of each connection member 4, into which a portion or an edge of rotor rib 14 may project, or stops may be provided for limiting the maximum swing angle of the respective connection member 4. The radially inner portion of each connection member has a spherical or cylindrical shape and is pivotally mounted in a corresponding seat provided in the associated piston 3. The seats and the respective portions of the connection members fitted therein are manufactured with spherical or cylindrical surfaces so that they form a tight seal against fluid losses.

To prevent a too-high surface pressure between the seat portions of connection member 4 and the seats in bearing rotor 2 and the associated pistons 3, pressure fluid pockets are provided in the end portions of connection members 4, or between these portions and the seat, in bearing rotor 2 and in piston 3, for a high-pressure design of the machine embodying the invention, these pockets being supplied with pressure fluid from the associated cylinder 5. Between each piston 3 and the inner end portion of the associated connection member 4, these pressure fluid pockets are formed either in piston 3 or, in a more simple manner, in the inner portion of the associated connection member. In FIG. 2, these pressure pockets are designated by the reference character 6.

The inner pressure fluid pockets 6 are connected to a bore 11 extending through the associated connection member 4 to one or preferably two pressure fluid pockets 12. Each bore or passage 11 therefore may be branched into several bores 11. Each outer pressure fluid pocket 12 could, in principle, be arranged radially opposite to the inner pressure fluid pocket 6. However, this could limit the piston stroke because, at a large swing of connection member 4, the pressure fluid pocket 12 could be exposed. It is therefore useful to provide pressure fluid pockets 12 in several parts, for example one at each side of circular groove 15 of bearing rotor 2, in the outer portion 10 of each connection member 4. That is, in this zone, the outer portion 10 is enclosed by seat 20 and the extension 41 thereof through more than 180°, and a large swing does not result in an exposure of a pressure fluid pocket 12. The inner pressure fluid pocket 6 is supplied with pressure fluid in a known manner from chamber 5 through a bore 7 provided in piston 3.

Tangential pressure fluid pockets 8 and 9 are formed in the circumferential peripheries of pistons 3. The supply of pressure fluid thereto is controlled by the swinging movement of the associated connection member 4 and by the inner pressure fluid pocket 6. That is, during a half revolution of the rotor, the pressure fluid pocket 6 communicates with the pressure fluid pocket 8 and, during the other half revolution, with the pressure fluid pocket 9. In accordance with the invention, the pressure fluid pockets 8 and 9 are of larger size than in the prior art, because the connection members of the invention swing through a larger angle.

At the right-hand side of FIG. 2, it is shown that, at the back of the inner portion of each connection member 4, the pressure fluid acts directly against the cylinder wall through the pressure fluid pocket 8, without any mechanical friction, and, on the side, in the respective outer portion 10 of the connection member, the pressure fluid pocket 12 acts almost directly in the tangential direction, that is, in the circumferential direction, against the seat 20 in bearing rotor 2, and again without any mechanical friction, and thereby imparts to the same a rotary motion. To illustrate this action, the outer pressure fluid pocket 12 is indicated, in one of the connection members 4, at the top side of FIG. 2.

In speaking about the absence of mechanical friction, it is meant that, due to the pressure fluid pockets, the connection members 4 are almost balanced, that is, in actual constructions, to approximately 95.6%, so that only about 4% of the pressure force from the cylinder produces a friction effect on piston 3.

To prevent reaction ring or rotor 2 from yielding under this tangential driving force in the circumferential direction, without transferring the imparted force to the exterior, a coupling means is arranged between rotor 1 and 2. In FIG. 2, this coupling means is indicated as an internal toothing on bearing roller 2 and has an external toothing on roller 1. The two toothings mesh with each other in the zone of the smallest eccentricity. In a design with an adjusting mechanism, the toothed portions 16 and 17 mesh with each other less when their eccentricity is decreased by adjustment of the stroke. To obtain a good possibility of controlling the stroke, the toothed portions or coupling parts 16 and 17 are made correspondingly deep, that is, with a corresponding intertooth depth and depth of engagement.

The particular embodiment of the invention shown in the drawing has been described as a hydrostatic or pneumatic motor. However, the machine can work inversely as a pump or compressor and, instead of providing the working rotor within the bearing rotor, the working rotor can be made hollow and have the bearing rotor mounted therein. The couplings means 16 and 17 transmit the rotation from one rotor to the other, and inversely.

While a specific embodiment of the invention has been shown and described in detail to illustrate the appliation of the principles of the invention, it will be understood that the invention may be embodied otherwise without departing from such principles.

In FIG. 3 it is demonstrated how the revolution in synchronism of the two rotors, so, that both rotors revolve substantially with the same rotary velocity can be achieved. Gear means 14 and 17 of FIGS. 1 and 3 may have the same number of teeth. Between the teeth of one of the rotors may teeth receiving-recesses may be provided. For example rotor 1 may have a number of gear-teeth 117. Rotor 2 then has the same number of teeth-receiving recesses 114 for the purpose of receiving a respective tooth of the other rotor. The teeth 117 and reception recesses 114 may have centers 147 and 144 respectively. Since there are the same number of teeth and of reception-recesses, but the centers of the teeth and recesses are on different diameters, the distances or arcuate distances between the centers 144 and 147 are different. In order, that the same number of teeth can operate at different dimeters of both rotors, the reception-recesses 114 are a little bit wider than the spaces between neighboring teeth 117 of the rotor 1. In order to make the smooth equal rotation of the two rotors 1 and 2 possible and reliable, the teeth 117 may be provided with suitable face-configurations 127 and 137, while the reception-recesses 114 may be provided also with respective suitable face-configurations 124 and 134. The face configurations 127, 137 are different from the face configurations 124 and 134. This example of a gearing means for revolution of two rotors with equal rotary velocity is however by way of example only. There are other gearing means for revolving two rotors in unison known from the former art. The type of the gearing means for revolving two rotor 1 and 2 in unison with equal, rotary velocity as described here can however be used for variable stroke-adjustment of the device by means of moving one of the rotors into different adjustable eccentricity bewteen the axes of the rotors. This can be achieved by making the reception-recesses 114 respectively deep and wide. The face-configurations discussed above must then be respectively formed.

I claim:

1. A radial-piston machine comprising: a housing; a bearing rotor rotatable in said housing about a bearing-rotor axis and formed with a plurality of angularly spaced radially opening swing seats; a working rotor rotatable in said housing about a working-rotor axis parallel to and spaced from said bearing-rotor axis and having a plurality of cylinders opening radially toward said bearing rotor, one of said rotors being formed with a guide ridge projecting radially toward the other rotor and said other rotor being formed with a radially open guide groove receiving said ridge at a zone of closest radial spacing between said rotors; gear means interconnecting said rotors for joint rotation at substantially the same angular speed; a piston radially reciprocal in each of said cylinders and having a side turned radially toward said bearing rotor and formed with a swing seat; and a plurality of connection members each having one swing-seat portion pivotally received in a respective swing seat of a respective piston and another swing-seat portion pivotally received in a respective swing seat of said bearing rotor, each of said connection members being extended axially in the respective swing seat of said other rotor and each being displaceable between a position bearing generally tangentially between the respective piston and said bearing rotor, and a position extending generally radially of one of said axes.

2. The radial-piston machine defined in claim 1 wherein at least said swing seats of said bearing rotor are shaped as part-cylindrical recesses.

3. The radial-piston machine defined in claim 1 wherein said swing seats of said bearing rotor overreach the respective swing portions of said connection members, whereby the swing portions of said connection members are radially nondisplaceable in said bearing rotor relative to said bearing-rotor axis.

4. The radial-piston machine defined in claim 1 wherein said bearing rotor surrounds said working rotor.

5. The radial-piston machine defined in claim 4 wherein said bearing rotor is formed with said groove, said seats of said bearing rotor extending axially to either axial side of said groove.

6. The radial-piston machine defined in claim 5 wherein said connection members are formed between said seat portions with a relatively thin neck partially receivable in said groove.

7. The radial-piston machine defined in claim 1 wherein said gear means includes a plurality of teeth on said bearing rotor and a plurality of teeth on said working rotor, said teeth having substantially the same angular spacing on both of said rotors.

8. The radial-piston machine defined in claim 7 wherein said ridge is formed on said working rotor and said groove is formed on said bearing rotor.

9. The radial-piston machine defined in claim 7 wherein said of said connection members is formed at each set portion with a lubricant-fluid pocket and with a passage extending between its pockets.

10. The radial-piston machine defined in claim 9 wherein each of said pistons is formed with a radially through-going passage, whereby fluid in said cylinders on the other sides of said pistons can pass through said passages and fill said pockets.

11. The radial-piston machine defined in claim 10 wherein each pistion is formed relative to a predetermined direction of rotation of said working rotor about its axis with a forwardly extending passage and a backwardly extending passage and with a fluid lubricant pocket at the ends of said passages, said fluid pockets on the portions of said members in said pistons being dimensioned to form a fluid link between the respective radial passage and a one of the other passages of the respective piston.

12. The radial-piston machine defined in claim 10 wherein said connection members ride on a film of lubricant in said bearing rotor.

* * * * *